United States Patent [19]

Santiago

[11] Patent Number: 4,629,605

[45] Date of Patent: Dec. 16, 1986

[54] DEVICE FOR CATALYTICALLY PURIFYING EXHAUST GASES FOR A COMBUSTION ENGINE

[75] Inventor: Enrique Santiago, Diedorf, Fed. Rep. of Germany

[73] Assignee: Zeuna-Staerker GmbH & Co. KG, Fed. Rep. of Germany

[21] Appl. No.: 726,275

[22] Filed: Apr. 24, 1985

Related U.S. Application Data

[63] Continuation of Ser. No. 438,795, Nov. 3, 1982, abandoned, which is a continuation of Ser. No. 261,160, Apr. 30, 1981, abandoned.

[30] Foreign Application Priority Data

Sep. 9, 1979 [DE] Fed. Rep. of Germany ..... 2935470

[51] Int. Cl.[4] ..... B01J 8/00; B01J 35/04

[52] U.S. Cl. ..... 422/179; 422/180

[58] Field of Search ..... 422/179, 177, 180, 221, 422/222

[56] References Cited

U.S. PATENT DOCUMENTS

| | | | |
|---|---|---|---|
| 3,963,445 | 6/1976 | Koyama et al. | 422/179 |
| 3,990,859 | 11/1976 | Waite | 422/180 X |
| 4,269,807 | 5/1981 | Bailey et al. | 422/179 |
| 4,278,717 | 7/1981 | Aoyama | 422/179 X |
| 4,279,864 | 7/1981 | Nara et al. | 422/179 |
| 4,344,921 | 8/1982 | Santiago et al. | 422/179 |
| 4,353,872 | 10/1982 | Midorikawa | 422/179 |

FOREIGN PATENT DOCUMENTS

| | | | |
|---|---|---|---|
| 1089769 | 11/1980 | Canada | 422/180 |

*Primary Examiner*—Michael S. Marcus

*Attorney, Agent, or Firm*—Brumbaugh, Graves, Donohue & Raymond

[57] ABSTRACT

Device for catalytically purifying exhaust gases from a combustion engine and process for implementing such device. A porous catalyst body bears against the inner walls of a casing above a winding of a metal wire netting. The annular space between the catalyst body (1) and the casing (2) is obturated by means of an annular seal made of a non-inflammable ceramic fibre material, so that such fibre material is pressed inside and between the windings of the wire netting (3). Further, the wire netting is wound with a superposed layer of fibre material.

4 Claims, 4 Drawing Figures

DEVICE FOR CATALYTICALLY PURIFYING EXHAUST GASES FOR A COMBUSTION ENGINE

Figure 1:
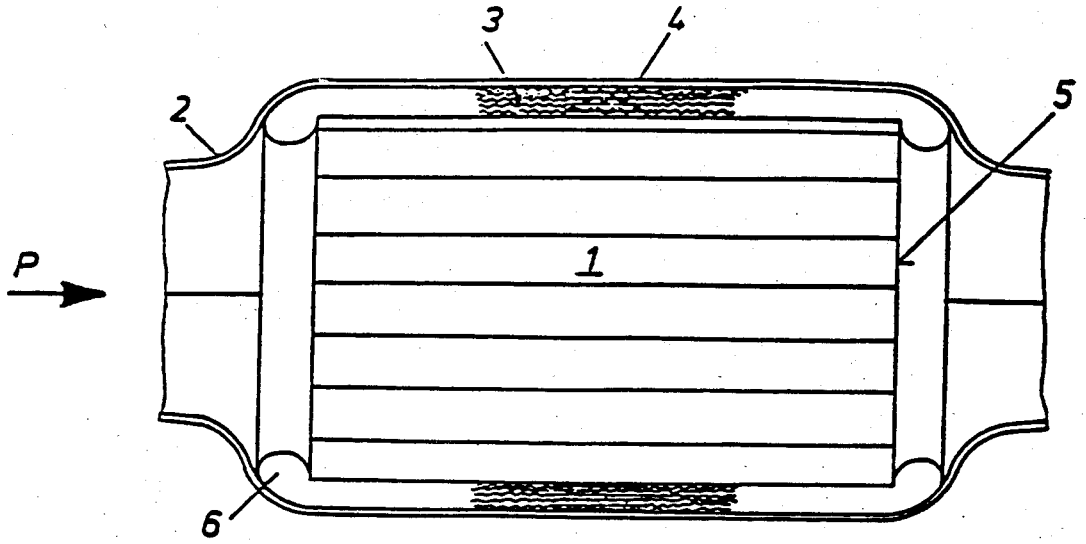

This application is a continuation of application Ser. No. 438,795, filed on Nov. 3, 1982, now abandoned, which is a continuation of of application Ser. No. 261,160, filed Apr. 30, 1981, now abandoned.

The invention relates to a device for the catalytic purification of internal-combustion engine exhaust gases, where a monolithic catalyzer body, gas thru-flowable across its peripheral area, is elastically supported inside a metallic housing against its housing internal surfaces by inserts each made of a metal-wire meshwork being tightly lapped around said catalyzer body in one or more layers and/or by structural parts being rigidly connected to said housing. Thereby the annular space between catalyzer body and housing is gas-tightly sealed by means of a circumferential joint made of non-combustible ceramic fiber material.

The invention relates further to a process for manufacturing a metal-wire meshwork and fiber material made lap for the purpose of supporting and packing the catalyzer body against the housing.

With a prior art device of the initially described type (German laid-open patent spec No. 2,400,443) the catalyzer body in the area of both of its end surfaces is respectively provided with a double-layered riffled-wire knit-fabric lap extending over less than half the axial length, which serves the shock-proof positioning of the catalyzer body.

The annular space in the area between both of said laps is completely filled with non-combustible fiber material so that said annular space is gastight-sealed, and the waste gases are forced to flow through the catalyzer body. Thus the catalyzer body surrounding jacket comprises three parts, which makes for an expensive manufacturing input; furthermore, this does not guarantee an axial grip of both riffled-wire knit-fabric laps. Finally there is a problem with matching the compression of the fiber material with that of of the riffled-wire knit fabric, so that a different fiber material pressure required for a gastight seal cannot be assured over an extended operating time. Furthermore, because of a slackening of fiber material elasticity with extended operating time there is the danger present of an annular packing blow-out produced by waste gas pulsation effects.

At variance therewith the object of the invention is to create an annular packing for matching the lifetime of the device, which can be manufactured in a particularly simple way.

According to the invention this problem is solved in such a way that the fiber material is provided inside and between meshwork laps, at least in the area of one or several axial sections, with such a gastight compression that any circulation around the catalyzer body outside of its peripheral area is eliminated. Thereby, generally, it is sufficient that said fiber material is provided only in the area of a narrow central axial section of the meshwork involved.

In this case meshwork and fiber material produce a tightly interpenetrating compound with a high compression of said fiber material obtained between wire meshes. Said meshes are simultaneously effective as fiber material reinforcement so that any fiber blow-out is safely avoided.

The key factor for the packing effect here is the intimate and completely mutual penetration of mesh wire and fiber material; a prior art embodiment—in addition to a wire-knit fabric—uses fiber rings, which are pressed in between catalyzer body and wire-knit fabric or between wire-knit fabric and housing. This does not produce a completely gastight packing.

Because the fiber material being annular-distributed over the entire catalyzer body periphery is present only in the area of small axial sections a particularly high compression within said sections of the fiber material thickened meshwork lapping is obtained. Aside from a constant packing effect the advantage of this arrangement is that said fiber material filled axial section can be arranged at any distance from the catalyzer body-end surface, so that the gas flow at annular packing points has only a fiber material saving low velocity.

A particularly advantageous process for manufacturing fiber material made annular packings as these, and metal-wire meshwork made laps is by lapping the meshwork together with a layer-by-layer type of fiber coating. On a lapping of catalyzer bodies, generally, two to five layers are effective. This may fiber material and meshwork are processed in a single lapping stage with an intimate interpenetration of mesh wire and fibers, so that a gaseous attack-and leak resistant type of annular packing is produced.

A particularly cost-optimal development of the process according to the invention is to wind up the meshwork in the form of a tape having an about catalyzer body-axial length matching width, which is equipped with one or more coatings of narrow fiber material strips. Such a tape can overlap both catalyzer body-end surfaces and that may simultaneously form an axially elastic catalyzer body support; at the same time this produces a solid axial grip of the wound-up tape.

Figure 2:
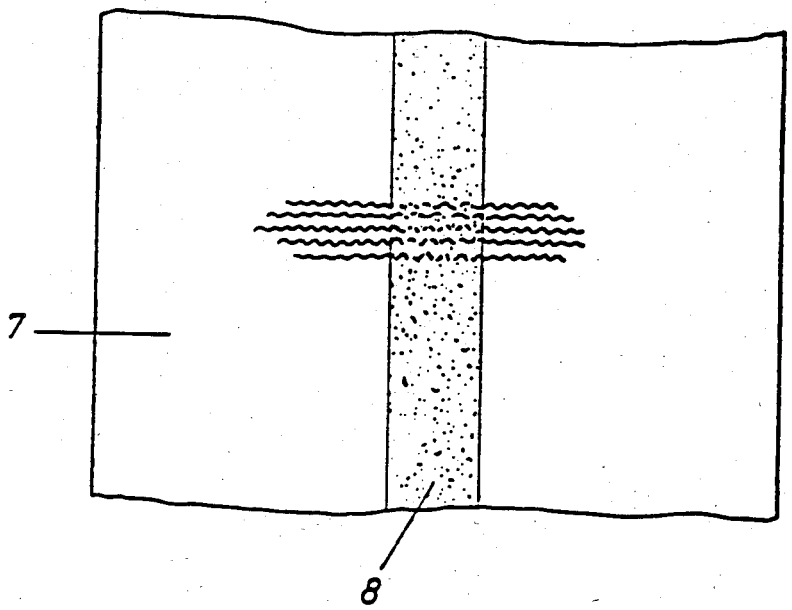

Below an exemplified embodiment of the invention is explained with reference to an attached drawing, wherein FIG. 1 shows an axial longitudinal cut through a catalyzer device;

FIG. 2 a section of a lap layer, and

Figure 3:
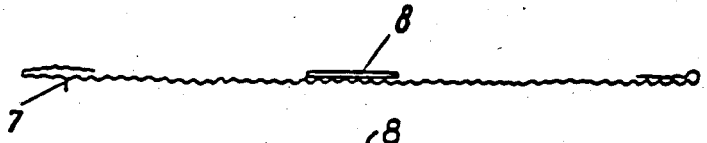
Figure 4:
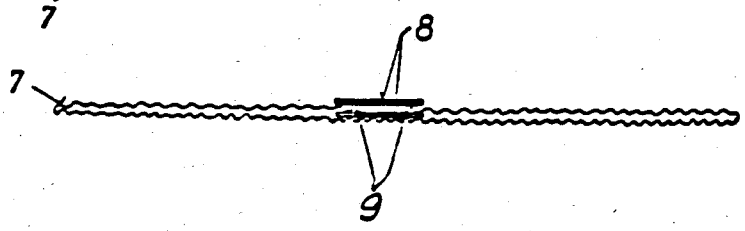

FIGS. 3 and 4 resp. a cross-section through a lap layer.

According to FIG. 1 a monolithic catalyzer body 1, the structure of which forms the finest type of axial flow channels, and which is axially flown through in the direction of arrow P, is axial-elastically supported inside a steel housing 2 by means of an insert 3 made of a heat-proof metal-wire meshwork. The latter is multi-layer laminated, and interspersed in a central area 4 with fiber material, the latter comprising ceramic fibers, e.g., with an aluminum oxide or aluminum silicate base. Said material forms an annular packing against any penetration of waste gases into the annular space between catalyzer body 1-peripheral area and housing 2. The meshwork 3 is respectively doubled back around the catalyzer body 1-end surface edges so that it axially supports the catalyzer body-end surfaces 5 by means of flangings 6.

To produce a grip of this type and simultaneous packing in the annular space area between catalyzer body 1 and housing 2 a single structural part is used, namely a tape 7 shown in FIG. 2, which comprises a metal-wire meshwork having by way of a coating a fiber material made narrow strip 8. Though said coating can be extended over the entire width of tape 7, generally, a relatively narrow strip is sufficient, which is preferably so arranged that it covers a central axial section of the catalyzer body. The strip thickness measured perpendicularly to the tape 7-plane amounts to about 1 mm or less.

FIG. 3 schematizes a cross-sectional cut through tape 7, whereby the meshwork is bent over at the edges, so that a closed type of particularly strong-compressed end edge is produced in the area of lap flangings 6. Strip 8 is applied to the center of the meshwork, and effects in this area a correspondingly higher insert compression between catalyzer body 1 and metal housing 2.

FIG. 4 shows a cross-section through tape 7 with nearly up-to-the-center flanged meshwork edge sections, where in the central area two fiber material strips 8 are deposited, one beneath and one above both ends 9 of the meshwork. Tape 7 is tightly multi-layer lapped around catalyzer body 1, and then together with the latter is inserted into the metal housing, resp. with a split housing is arranged between both housing half-shells with a matchingly compacted meshwork, specifically in the area of catalyzer body-end surface edges and fiber material strips.

I claim:

1. In a device for catalytically purifying internal combustion engine exhaust gases comprising a monolithic catalyzer body having an axial length through which exhaust gases can pass, said body being elastically supported inside a metal housing by elastic supporting means such that an annular space is located between said body and an interior surface of the housing, said elastic supporting means being an annular packing located at least partially within said annular space and forming a gas-tight seal which substantially prevents the flow of exhaust gases around the catalyzer body and through the annular space, the improvement comprising;

said elastic supporting means being comprised of a plurality of layers substantially completely comprised of metal-wire meshwork and a plurality of layers substantially completely comprised of a non-combustible ceramic fiber material, said layers of metal-wire meshwork extending substantially the entire axial length of the catalyzer, said meshwork layers and fiber layers being alternately wrapped annularly around the catalyzer body and at least partially overlapping one another, said layers of ceramic material being wrapped around the catalyzer body in the form of strips, said housing, catalyzer body and elastic supporting means being arranged and constructed such that during assembly said layers are compressed between the catalyzer body and the interior surface of the housing to such an extent that said compression substantially alone causes the fiber material and metal-wire meshwork to substantially completely mutually penetrate each other in at least an axial section of the metal-wire meshwork thereby to form a gas-tight seal in the annular space to substantially prevent the flow of exhaust gases around the catalyzer body through the annular space.

2. A device according to claim 1 wherein said plurality of layers of fiber material is provided only in the area of a central axial section of the metal-wire meshwork.

3. A device according to claim 1 wherein at least one layer of the metal-wire meshwork is in the form of a strip having a width approximately matching the axial length of the catalyzer body and being wrapped around and covering the outside axial surface of said catalyzer body, and at least one layer of the fiber material is in the form of a strip having a width less than the width of the meshwork strip and being wrapped over and around said meshwork strip.

4. A device according to claim 1 wherein at least one layer of the metal-wire meshwork is in the form of a strip having a width approximately matching the axial length of the catalyzer body and being wrapped around and covering the outside axial surface of said catalyzer body, and at least one layer of the fiber material is in the form of a strip having a width less than the width of the meshwork strip and being wrapped over and around said meshwork strip.

* * * * *

UNITED STATES PATENT AND TRADEMARK OFFICE

CERTIFICATE OF CORRECTION

PATENT NO. : 4,629,605

DATED : Dec. 16, 1986

INVENTOR(S) : Enrique Santiago

It is certified that error appears in the above-identified patent and that said Letters Patent is hereby corrected as shown below:

Col. 1, line 7, "of of" should read --of--.

Col. 2, line 23, "may" should read --way--;
line 34, "may" should read --way--.

Col. 4, line 32, "claim 1" should read --claim 2--.

Signed and Sealed this

Thirty-first Day of March, 1987

*Attest:*

DONALD J. QUIGG

*Attesting Officer*

*Commissioner of Patents and Trademarks*